US007294611B2

(12) United States Patent
Metrot et al.

(10) Patent No.: US 7,294,611 B2
(45) Date of Patent: Nov. 13, 2007

(54) STRUCTURED LIQUID FABRIC TREATMENT COMPOSITIONS

(75) Inventors: Veronique Sylvie Metrot, Brussels (BE); Axel Masschelein, Brussels (BE); Jean-Pol Boutique, Gembloux (BE); Mark Allen Smerznak, Brussels (BE); Patrick Firmin August Delplancke, Laarne (BE); Luc Marie Willy Lievens, Mere (BE)

(73) Assignee: The Procter and Gamble Company, Cincinnati, OH (US)

( * ) Notice: Subject to any disclaimer, the term of this patent is extended or adjusted under 35 U.S.C. 154(b) by 0 days.

(21) Appl. No.: 11/409,768

(22) Filed: Apr. 24, 2006

(65) Prior Publication Data

US 2006/0189507 A1 Aug. 24, 2006

Related U.S. Application Data

(63) Continuation of application No. 10/656,524, filed on Sep. 5, 2003, now abandoned.

(30) Foreign Application Priority Data

Sep. 5, 2002 (EP) ..... 02447167

(51) Int. Cl.
*C11D 3/37* (2006.01)

(52) U.S. Cl. ..... 510/466

(58) Field of Classification Search ..... 510/466
See application file for complete search history.

(56) References Cited

U.S. PATENT DOCUMENTS

| | | | |
|---|---|---|---|
| 5,723,426 | A | 3/1998 | Zhen et al. |
| 6,495,498 | B2 | 12/2002 | Niemiec et al. |

FOREIGN PATENT DOCUMENTS

| | | | |
|---|---|---|---|
| EP | 028865 | * | 5/1981 |
| EP | 0150872 | | 8/1985 |
| EP | 1199350 | | 4/2002 |
| WO | 9943777 | | 9/1999 |
| WO | 0206403 | | 1/2002 |
| WO | 0218528 | | 3/2002 |

* cited by examiner

*Primary Examiner*—John R. Hardee
(74) *Attorney, Agent, or Firm*—Armina E. Matthews; Julie A. McConihay; Kim William Zerby

(57) ABSTRACT

The invention is directed to a structured liquid fabric treatment composition comprising as added components one or more silicone-based cationic fabric care ingredients preferably selected from the group consisting of cationic silicone polymers comprising one or more polysiloxane units and one or more quaternary nitrogen units; a structuring system comprising a structuring agent, a nonionic emulsifier and an anionic emulsifier; a cationic scavenging agent for the anionic emulsifier and a liquid carrier.

26 Claims, No Drawings

STRUCTURED LIQUID FABRIC TREATMENT COMPOSITIONS

CROSS REFERENCE TO RELATED APPLICATIONS

This application is a continuation application of U.S. application Ser. No. 10/656,524, filed Sep. 5, 2003; now abandoned which was the National Stage of International Application No. PCT/02447167.4, filed Sep. 5, 2002.

FIELD OF THE INVENTION

This invention relates to structured liquid fabric treatment compositions. The invention also relates to methods for treating fabrics in fabric treatment applications with such structured liquid fabric treatment compositions to thereby provide improved fabric care. This invention further relates to a process for preparing such fabric treatment compositions.

BACKGROUND OF THE INVENTION

When consumers launder fabrics, they desire not only excellence in fabric cleaning, they also seek to impart superior fabric care benefits. Such desired fabric care benefits can be exemplified by one or more of: superior garment appearance; excellent tactile characteristics, such as fabric feel; fabric softness; reduction, removal or prevention of creases or wrinkles in garments; color care; superior ease of ironing; garment shape retention and/or shape recovery; and fabric elasticity. Compositions which can provide fabric care benefits during laundering operations are known, for example in form of rinse-added fabric softening compositions. Compositions which can provide both cleaning and fabric care benefits, e.g., fabric softening benefits, at the same time, are also known, for example in the form of "2-in-1" compositions and/or "softening through the wash" compositions.

Fabric treatment compositions for use in laundering operations have been known for many years. They are available in solid form, e.g. in form of granules, in form of compressed tablets, and in liquid forms, e.g. as liquid compositions. Current liquid fabric treatment compositions comprise a fabric care ingredient, which is typically a cationic compound. More typically the cationic fabric care ingredient is a cationic silicone polymer comprising one or more polysiloxane units and one or more quaternary nitrogen units. WO 02/18 528 (P&G, published Mar. 07, 2002) describes fabric care compositions comprising a cationic silicone fabric care component and a nonionic surfactant.

Cationic fabric care materials such as the silicone-based quaternary nitrogen materials just described are generally insoluble in liquid fabric treatment compositions. Accordingly they are generally found in such liquid products in the form of emulsions or dispersions. These liquid compositions will thus frequently contain, in addition to the fabric care agent, a structuring system comprising an emulsified structuring agent. Such a structuring system serves to stabilize the cationic fabric care materials within the liquid fabric treatment compositions and to provide such liquid compositions with suitable rheological characteristics.

The structuring systems for liquid fabric care compositions, typically in the form of emulsified, crystal-forming stabilizing agents, are frequently prepared as a premix and then added to the liquid products which contain the cationic fabric care ingredients. In preparing such emulsified premixes of structuring agent, care is generally taken not to employ any emulsifiers which would be incompatible with the cationic fabric care materials in the fabric care compositions with which the emulsified structuring system will be combined. Accordingly, such structuring systems will generally comprise a mixture of a structuring agent and nonionic, and/or amphoteric emulsifiers.

It has been found that addition of small amounts of anionic emulsifiers to structuring systems for cationic fabric care compositions can greatly enhance the ability of the structuring system to provide structured liquid fabric care compositions of especially desirable stability and rheology. However, it has also been observed that the fabric care performance of the silicone-based cationic active decreases dramatically with the addition of a structuring system containing even very low levels of anionic emulsifier. Without being bound by theory, it is believed that the decrease in the fabric care performance occurs due to an interaction of the anionic emulsifier with the cationic fabric care ingredient, e.g. via ion-ion-pair formation of the anionic emulsifier of the structuring system and of the cationic fabric care ingredient.

The present invention addresses this technical problem and provides a solution to overcome this problem. Accordingly, it is an object of the present invention to provide fabric care compositions showing improved stability and rheology, in terms of good emulsification, structuring, and viscosity, and still provide superior fabric care.

It has been surprisingly found that the addition to the compositions herein of a cationic scavenging agent for the anionic emulsifier of the structuring system solves the problem set forth hereinabove. Without being bound by theory, it is believed that the addition of a cationic scavenging agent prevents the interaction of the anionic emulsifier of the structuring system with the silicone based cationic fabric care ingredient.

SUMMARY OF THE INVENTION

The invention relates to structured liquid fabric treatment compositions which have especially desirable stability and rheological characteristics and which impart superior fabric care benefits to fabrics treated herewith. Such compositions comprise, as added components, one or more silicone-based cationic fabric care ingredients, a multi-component structuring system, a cationic scavenging agent and a liquid carrier. The silicone-based cationic fabric care ingredients are preferably selected from the group consisting of one or more cationic silicone polymers comprising one or more polysiloxane units and one or more quaternary nitrogen moieties.

The structuring system comprises a structuring agent which is preferably a crystalline, hydroxyl-containing structuring agent, and a mixture of emulsifiers. The structuring system emulsifiers comprise at least one nonionic emulsifier and at least one anionic emulsifier.

The cationic scavenging agent is one which is capable of reacting, at an appropriate point during the preparation of the compositions herein, with the anionic emulsifier of the structuring system. The cationic scavenging agent is preferably a quaternary ammonium salt.

The invention further is directed to the use of the structured liquid fabric treatment compositions of the present invention to impart fabric care benefits to a fabric substrate. This is preferably done by contacting a substrate in need of treatment with a composition of the invention herein. Preferably, such contacting is carried out in an aqueous solution or dispersion of such a fabric treatment composition.

The present invention also relates to a process for preparing such compositions. Such a process comprises the preparation of several premixes, followed by combining them to form the final composition. One such premix comprises the silicone-based cationic fabric care ingredients and the liquid carrier and optionally the cationic scavenging agent. Another such premix comprises the structuring system. Yet another premix may be optionally prepared, containing a mixture of all other composition components. The cationic scavenging agent may be added to the fabric care ingredient premix or to the optional ingredient premix.

The invention also includes products in a wide range of forms and types. The objects, features and advantages of the invention are further borne out in the following detailed description, examples and appended claims.

DETAILED DESCRIPTION OF THE INVENTION

Definitions: The term "substrate" as used herein means a substrate, especially a fabric or garment, having one or more of the fabric care benefits described herein, imparted thereto by contact with a composition of the present invention.

A, Silicone-based Cationic Fabric Care Ingredient—One essential element as added component of the compositions of the present invention is a silicone-based cationic fabric care ingredient. Suitable levels of this component are in the range from 0.1% to 20%, preferably from 0.15% to 10%, and more preferably from 0.2% to 2.5%, by weight of the composition.

In principle, any silicone-based cationic fabric care ingredient can be used. However, certain silicone-based cationic fabric care ingredients are preferred.

The cationic silicone polymer preferably selected for use in the present compositions comprises one or more polysiloxane units, preferably polydimethylsiloxane units of formula —$\{(CH_3)_2SiO\}_n$— having a degree of polymerization, n, of from 50 to 200 and organosilicon-free units comprising at least one diquaternary unit. In preferred embodiments of the invention, the selected cationic silicone polymer has from 0.50 to 1.0 weight fraction of said organosilicon-free units selected from N,N,N',N'-tetramethyl-1,6-hexanediammonium units.

The selected cationic silicone polymer can also contain from 0.0 to 0.20 weight fraction, in certain embodiments a non-zero amount, of the total of organosilicon-free units of —$NHCH(CH_3)CH_2O(AO)_aCH_2CH(CH_3)NH$— units wherein AO represents ethyleneoxy, propyleneoxy, butyleneoxy and mixtures thereof and a is from 5 to 70.

The selected cationic silicone polymer can also contain from 0.0, in certain embodiments a non-zero amount to 0.20 weight fraction, of the total of organosilicon-free units of —$NR_3$+ wherein R is alkyl, hydroxyalkyl or phenyl. These units can be thought of as end-caps.

Moreover the selected cationic silicone polymer generally contains anions, selected from inorganic and organic anions, more preferably selected from saturated and unsaturated $C_1$-$C_{20}$ carboxylates and mixtures thereof, to balance the charge of the quaternary moieties, thus the cationic silicone polymer also comprises such anions in a quaternary charge-balancing proportion.

Conceptually, the selected cationic silicone polymers herein can helpfully be thought of as non-crosslinked or "linear" block copolymers including non-fabric-substantive but surface energy modifying "loops" made up of the polysiloxane units, and fabric-substantive "hooks". One preferred class of the selected cationic polymers (illustrated by Structure 1 hereinafter) can be thought of as comprising a single loop and two hooks; another, very highly preferred, comprises two or more, preferably three or more "loops" and two or more, preferably three or more "hooks" (illustrated by Structures 2a and 2b hereinafter), and yet another (illustrated by Structure 3 hereinafter) comprises two "loops" pendant from a single "hook".

Of particular interest in the present selection of cationic silicone polymers is that the "hooks" contain no silicon and that each "hook" comprises at least two quaternary nitrogen atoms.

Also of interest in the present selection of preferred cationic silicone polymers is that the quaternary nitrogen is preferentially located in the "backbone" of the "linear" polymer, in contradistinction from alternate and less preferred structures in which the quaternary nitrogen is incorporated into a moiety or moieties which form a "pendant" or "dangling" structure off the "backbone".

The structures are completed by terminal moieties which can be noncharged or, when charged, can comprise only one quaternary nitrogen atom, as in the moiety —$NR_3$+ wherein R is alkyl. Moreover a certain proportion of nonquaternary silicone-free moieties can be present, for example the moiety —$NHCH(CH_3)CH_2O(AO)_aCH_2CH(CH_3)NH$— described hereinabove.

Of course the conceptual model presented is not intended to be limiting of other moieties, for example connector moieties, which can be present in the selected cationic silicone polymers provided that they do not substantially disrupt the intended function as fabric benefit agents.

In more detail, the preferred cationic silicone polymers herein have one or more polysiloxane units and one or more quaternary nitrogen moieties, including polymers wherein the cationic silicone polymer has the formula: (Structure 1)

STRUCTURE 1

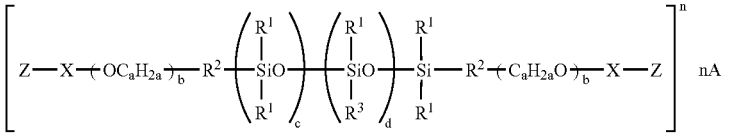

wherein:

$R^1$ is independently selected from the group consisting of: $C_{1-22}$ alkyl, $C_{2-22}$ alkenyl, $C_{6-22}$ alkylaryl, aryl, cycloalkyl and mixtures thereof;

$R^2$ is independently selected from the group consisting of: divalent organic moieties that may contain one or more oxygen atoms (such moieties preferably consist essentially of C and H or of C, H and O);

X is independently selected from the group consisting of ring-opened epoxides;

$R^3$ is independently selected from polyether groups having the formula:

$$-M^1(C_aH_{2a}O)_b-M^2$$

wherein $M^1$ is a divalent hydrocarbon residue; $M^2$ is H, $C_{1-22}$ alkyl, $C_{2-22}$ alkenyl, $C_{6-22}$ alkylaryl, aryl; cycloalkyl, $C_{1-22}$ hydroxyalkyl, polyalkyleneoxide or (poly)alkoxy alkyl;

Z is independently selected from the group consisting of monovalent organic moieties comprising at least one quaternized nitrogen atom;

a is from 2-4; -b is from 0-100; -c is from 1-1000, preferably greater than 20, more preferably greater than 30, even more preferably greater than 50, preferably less than 500, more preferably less than 300, even more preferably less than 200, most preferably from 70 to 100; -d is from 0-100; -n is the number of positive charges associated with the cationic silicone polymer, which is greater than or equal to 2; and -A is a monovalent anion.

In a preferred embodiment of the Structure 1 cationic silicone polymers, Z is independently selected from the group consisting of:

(i)

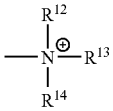

(ii)

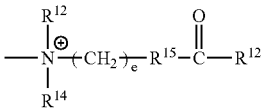

(iii)

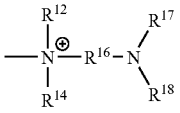

-continued (iv)

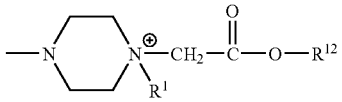

(v) monovalent aromatic or aliphatic heterocyclic group, substituted or unsubstituted, containing at least one quaternized nitrogen atom;

wherein:

$R^{12}$, $R^{13}$, $R^{14}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl, and mixtures thereof;

$R^{15}$ is —O— or $NR^{19}$;

$R^{16}$ is a divalent hydrocarbon residue;

$R^{17}$, $R^{18}$, $R^{19}$ are the same or different, and are selected from the group consisting of: H, $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide, (poly)alkoxy alkyl and mixtures thereof; and e is from 1 to 6.

In a highly preferred embodiment, the cationic silicone polymers herein have one or more polysiloxane units and one or more quaternary nitrogen moieties, including polymers wherein the cationic silicone polymer has the formula: (Structure 2a)

STRUCTURE 2a: Cationic silicone polymer composed of alternating units of:

(i) a polysiloxane of the following formula

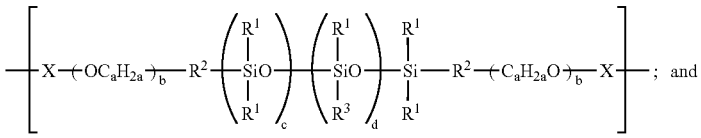

; and (ii) a divalent organic moiety comprising at least two quaternized nitrogen atoms.

Note that Structure 2a comprises the alternating combination of both the polysiloxane of the depicted formula and the divalent organic moiety, and that the divalent organic moiety is organosilicon-free corresponding to a preferred "hook" in the above description.

In this preferred cationic silicone polymer, $R^1$ is independently selected from the group consisting of: $C_{1-22}$ alkyl, $C_{2-22}$ alkenyl, $C_{6-22}$ alkylaryl, aryl, cycloalkyl and mixtures thereof;

$R^2$ is independently selected from the group consisting of: divalent organic moieties that may contain one or more oxygen atoms;

X is independently selected from the group consisting of ring-opened epoxides;

$R^3$ is independently selected from polyether groups having the formula:

$$-M^1(C_aH_{2a}O)_b-M^2$$

wherein $M^1$ is a divalent hydrocarbon residue; $M^2$ is H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide or (poly)alkoxy alkyl;

a is from 2-4; -b is from 0-100; -c is from 1-1000, preferably greater than 20, more preferably greater than 30, even more preferably greater than 50, preferably less than 500, more preferably less than 300, even more preferably less than 200, most preferably from 70 to 100; and -d is from 0-100.

In an even more highly preferred embodiment of the Structure 2a cationic silicone polymer, the cationic silicone polymer has the formula Structure 2b wherein the polysiloxane of the formula described above as Structure 2a is present with a cationic divalent organic moiety selected from the group consisting of:

(a)

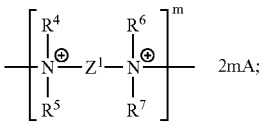

2mA;

(b)

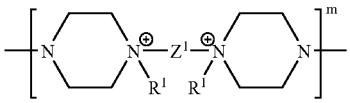

2mA;

(c)

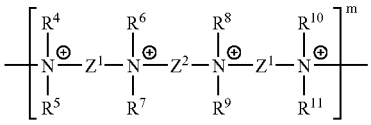

4mA;

(d) a divalent aromatic or aliphatic heterocyclic group, substituted or unsubstituted, containing at least one quaternized nitrogent atom; and (iii) optionally, a polyalkyleneoxide of formula:

$[Y—O—(C_aH_{2a}O)_b—Y]$; and (iv) optionally, a cationic monovalent organic moiety, to be used as an end-group, selected from the group consisting of:

(i)

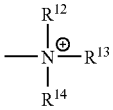

(ii)

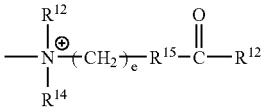

(iii)

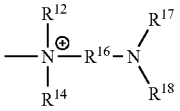

-continued (iv)

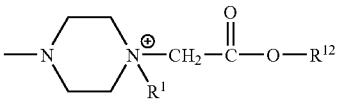

(v) monovalent aromatic or aliphatic heterocyclic group, substituted or unsubstituted, containing at least one quaternized nitrogen atom;

wherein:

$R^4$, $R^5$, $R^6$, $R^7$, $R^8$, $R^9$, $R^{10}$, $R^{11}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl and mixtures thereof; or in which $R^4$ and $R^6$, or $R^5$ and $R^7$, or $R^8$ and $R^{10}$, or $R^9$ and $R^{11}$ may be components of a bridging alkylene group;

$R^{12}$, $R^{13}$, $R^{14}$ are the same or different, and are selected from the group consisting of: $C_{1-22}$ alkyl; $C_{2-22}$ alkenyl; $C_{6-22}$ alkylaryl; $C_{1-22}$ hydroxyalkyl; polyalkyleneoxide; (poly) alkoxy alkyl groups and mixtures thereof; and $R^{15}$ is —O— or $NR^{19}$;

$R^{16}$ and $M^1$ are the same or different divalent hydrocarbon residues;

$R^{17}$, $R^{18}$, $R^{19}$ are the same or different, and are selected from the group consisting of: H, $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide, (poly)alkoxy alkyl, and mixtures thereof; and $Z^1$ and $Z^2$ are the same or different divalent hydrocarbon groups with at least 2 carbon atoms, optionally containing a hydroxy group, and which may be interrupted by one or several ether, ester or amide groups;

Y is a secondary or tertiary amine;

a is from 2-4; -b is from 0-100; -c is from 1-1000, preferably greater than 20, more preferably greater than 30, even more preferably greater than 50, preferably less than 500, more preferably less than 300, even more preferably less than 200, most preferably from 70 to 100; and -d is from 0-100; -e is from 1-6; -m is the number of positive charges associated with the cationic divalent organic moiety, which is greater than or equal to 2; and -A is an anion.

Note that Structure 2b comprises the alternating combination of both the polysiloxane of the depicted formula and the divalent organic moiety, and that the divalent organic moiety is organosilicon-free corresponding to a preferred "hook" in the above general description. Structure 2b moreover includes embodiments in which the optional polyalkyleneoxy and/or end group moieties are either present or absent.

In yet another embodiment, the cationic silicone polymers herein have one or more polysiloxane units and one or more quaternary nitrogen moieties, and including polymers wherein the cationic silicone polymer has the formula: (Structure 3)

STRUCTURE 3

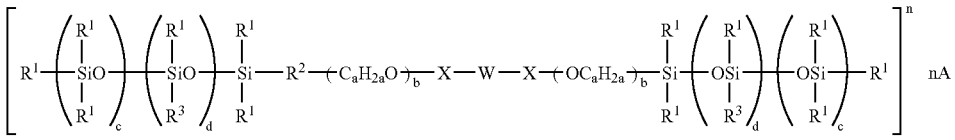

wherein:

$R^1$ is independently selected from the group consisting of: $C_{1-22}$ alkyl; $C_{2-22}$ alkenyl; $C_{6-22}$ alkylaryl; aryl; cycloalkyl and mixtures thereof;

$R^2$ is independently selected from the group consisting of: divalent organic moieties that may contain one or more oxygen atoms;

X is independently selected from the group consisting of ring-opened epoxides;

$R^3$ is independently selected from polyether groups having the formula:

$$-M^1(C_aH_{2a}O)_b-M^2$$

wherein $M^1$ is a divalent hydrocarbon residue; $M^2$ is H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide or (poly)alkoxy alkyl;

X is independently selected from the group consisting of ring-opened epoxides;

W is independently selected from the group consisting of divalent organic moieties comprising at least one quaternized nitrogen atom a is from 2-4; -b is from 0-100; -c is from 1-1000, preferably greater than 20, more preferably greater than 30, even more preferably greater than 50, preferably less than 500, more preferably less than 300, even more preferably less than 200, most preferably from 70 to 100; -d is from 0-100; -n and m are the number of positive charges associated with the cationic silicone polymer, which is greater than or equal to 1; and -A is a monovalent anion, in other words, a suitable couterion.

In preferred cationic silicone polymers of Structure 3, W is selected from the group consisting of:

(a)

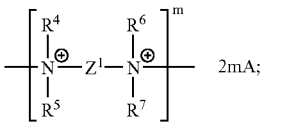

(b)

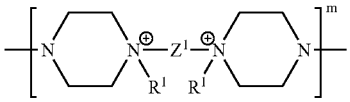

(c)

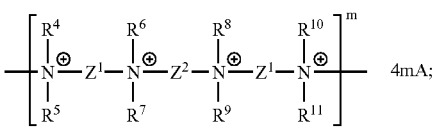

(d) a divalent aromatic or aliphatic heterocyclic group, substituted or unsubstituted, containing at least one quaternized nitrogent atom; and $R^4$, $R^5$, $R^6$, $R^7$, $R^8$, $R^9$, $R^{10}$, $R^{11}$ are the same or different, and are selected from the group consisting of: $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl, and mixtures thereof; or in which $R^4$ and $R^6$, or $R^5$ and $R^7$, or $R^8$ and $R^{10}$, or $R^9$ and $R^{11}$ may be components of a bridging alkylene group; and $Z^1$ and $Z^2$ are the same or different divalent hydrocarbon groups with at least 2 carbon atoms, optionally containing a hydroxy group, and which may be interrupted by one or several ether, ester or amide groups.

Reference is made to the following patents and patent applications which do also disclose preferred cationic silicone polymers suitable for use in the present invention: WO 02/06 403; WO 02/18 528, EP 1 199 350; WO 00/24 853; WO 02/10 259 and WO 02/10 256.

Mixtures of the above materials can be used in any proportion.

B, Structuring System—The present compositions further comprise as another essential added component a structuring system comprising a structuring agent, a nonionic emulsifier and an anionic emulsifier. The structuring system is present of from 0.1% to 20%, preferably from 0.15% to 15%, more preferably from 0.2% to 5% by weight of the composition. The weight ratio between the nonionic emulsifier and the anionic emulsifier is preferably between 100:1 to 1:1, more preferably between 10:1 and 1.5:1 and even more preferably between 8:1 and 2:1.

Structuring Agent: Suitable levels of this component are in the range from 0.1% to 90%, preferably from 0.2% to 50%, and even more preferably from 0.5% to 10% by weight of the structuring system. The structuring agent serves to stabilize the fabric care compositions herein and to prevent the fabric care compositions herein from coagulating and/or creaming.

Preferably the structuring agent is a crystalline, hydroxyl-containing structuring agent, more preferably still, a trihydroxystearin, hydrogenated oil or a variation thereof.

Without intending to be limited by theory, the crystalline, hydroxyl-containing stabilizing agent is a nonlimiting example of an agent which forms a "thread-like structuring system." "Thread-like Structuring System" as used herein means a system comprising one or more agents that are capable of providing a chemical network that reduces the tendency of materials with which they are combined to coalesce and/or phase split. Examples of the one or more agents include crystalline, hydroxyl-containing stabilizing agents and/or hydrogenated jojoba. Without wishing to be bound by theory, it is believed that the thread-like structuring system forms a fibrous or entangled threadlike network in-situ on cooling of the matrix. The thread-like structuring system has an average aspect ratio of from 1.5:1, preferably from at least 10:1, to 200:1.

The thread-like structuring system can be made to have a viscosity of 2000 cstks or less at an intermediate shear range ($5\ s^{-1}$ to $50\ s^{-1}$) which allows for the pouring of the composition out of a standard bottle, while the low shear viscosity of the product at $0.1\ s^{-1}$ can be at least 2000 cstks but more preferably greater than 20,000 cstks. A process for the preparation of a thread-like structuring system is disclosed in WO 02/18528.

Crystalline, hydroxyl-containing stabilizing agents can be fatty acid, fatty ester or fatty soap water-insoluble wax-like substance.

The crystalline, hydroxyl-containing stabilizing agents in accordance with the present invention are preferably derivatives of castor oil, especially hydrogenated castor oil derivatives. For example, castor wax.

The crystalline, hydroxyl-containing agent typically is selected from the group consisting of:

i)

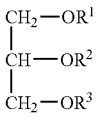

wherein $R^1$ is —C(O)$R^4$, $R^2$ is $R^1$ or H, $R^3$ is $R^1$ or H, and $R^4$ is independently $C_{10}$-$C_{22}$ alkyl or alkenyl comprising at least one hydroxyl group;

ii)

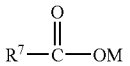

wherein:

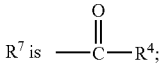

$R^4$ is as defined above in i);

M is $Na^+$, $K^+$, $Mg^{++}$ or $Al^{3+}$, or H; and iii) mixtures thereof.

Alternatively, the crystalline, hydroxyl-containing stabilizing agent may have the formula:

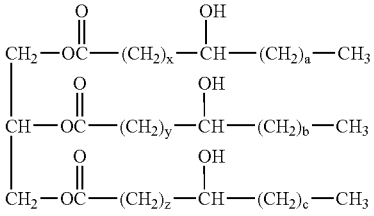

wherein:

(x+a) is from between 11 and 17; (y+b) is from between 11 and 17; and (z+c) is from between 11 and 17. Preferably, wherein x=y=z=10 and/or wherein a=b=c=5.

Commercially available crystalline, hydroxyl-containing stabilizing agents include THIXCIN® from Rheox, Inc.

Nonionic emulsifier: The structuring system of the present invention must comprise a nonionic emulsifier. This component is generally present at levels in the range from 5% to 90%, preferably from 7% to 50%, more preferably from 10% to 20% by weight of the structuring system.

Essentially any nonionic emulsifier in general can be used. Preferred are alkoxylated nonionic emulsifiers, suitably one containing only carbon, hydrogen and oxygen to be included in the present compositions, although amidofunctional and other heteroatom-functional types can in general also be used. Ethoxylated, propoxylated, butoxylated or mixed alkoxylated, for example ethoxylated/propoxylated aliphatic or aromatic hydrocarbyl chain nonionic emulsifiers are more preferred. Suitable hydrocarbyl moieties can contain from 6 to 22 carbon atoms and can be linear, branched, cycloaliphatic or aromatic and the nonionic emulsifier can be derived from a primary or secondary alcohol.

Preferred alkoxylated emulsifiers can be selected from the classes of the nonionic condensates of ethoxylated and ethoxylated/propoxylated or propoxylated/ethoxylated linear or lightly branched monohydric aliphatic alcohols, which can be natural or synthetic. Alkylphenyl alkoxylates such as the nonylphenyl ethoxylates can also suitably be used.

Especially suitable as nonionic emulsifiers are the condensation products of primary aliphatic alcohols with from 1 to 75 moles of $C_2$-$C_3$ alkylene oxide, more suitably 1 to 15 moles, preferably 1 to 11 moles. Particularly preferred are the condensation products of alcohols having an alkyl group containing from 8 to 20 carbon atoms with from 2 to 9 moles and in particular 3 or 5 moles, of ethylene oxide per mole of alcohol.

Suitable nonionic emulsifiers containing nitrogen as heteroatom include the polyhydroxy fatty amides having the structural formula $R^1CONR^2Z$ wherein $R^1$ is a $C_5$-$C_{31}$ hydrocarbyl, preferably straight-chain $C_7$-$C_{19}$ alkyl or alkenyl, more preferably straight-chain $C_{11}$-$C_{17}$ alkyl or alkenyl, or mixture thereof; $R^2$ is H, $C_{1-18}$, preferably $C_1$-$C_4$ hydrocarbyl, 2-hydroxethyl, 2-hydroxypropyl, ethoxy, propoxy, or a mixture thereof, preferably $C_1$-$C_4$ alkyl, more preferably methyl; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar such as glucose, a corresponding preferred compound being a $C_{11}$-$C_{17}$ alkyl N-methyl glucamide.

Other nonionic emulsifiers useful herein include the so-called "capped" nonionics in which one or more —OH moieties are replaced by —OR wherein R is typically lower alkyl such as C1-C3 alkyl; the long-chain alkyl polysaccharides, more particularly the polyglycoside and/or oligosaccharide type, as well as nonionic emulsifiers derivable by esterifying fatty acids.

Other suitable nonionic emulsifiers belong to the group of semi-polar emulsifiers having the formula: $R(EO)_x(PO)_y(BO)_zN(O)(CH_2R')_2.qH_2O$ (I). R is a relatively long-chain hydrocarbyl moiety which can be saturated or unsaturated, linear or branched, and can contain from 8 to 20, preferably from 10 to 16 carbon atoms, and is more preferably C12-C16 primary alkyl. R' is a short-chain moiety preferably selected from hydrogen, methyl and —$CH_2OH$, x, y, z are each from 0 to 100. When x+y+z is different from 0, EO is ethyleneoxy, PO is propyleneneoxy and BO is butyleneoxy. Amine oxide surfactants are illustrated by $C_{12-14}$ alkyldimethyl amine oxide.

Still another group of suitable nonionic emulsifiers is selected from the group of amine emulsifiers, preferably an amine emulsifier having the formula $RX(CH_2)_xNR^2R^3$ wherein R is $C_6$-$C_{12}$ alkyl; X is a bridging group which is selected from NH, CONH, COO, or O or X can be absent; x is from 2 to 4; $R_2$ and $R_3$ are each independently selected from H, $C_1$-$C_4$ alkyl, or ($CH_2$—$CH_2$—O($R_4$)) wherein $R_4$ is H or methyl. Particularly preferred emulsifiers of this type include those selected from the group consisting of decyl amine, dodecyl amine, $C_8$-$C_{12}$ bis(hydroxyethyl)amine, $C_8$-$C_{12}$ bis(hydroxypropyl)amine, $C_8$-$C_{12}$ amido propyl dimethyl amine, and mixtures thereof.

This group of emulsifiers also includes fatty acid amide emulsifiers having the formula $RC(O)NR'_2$ wherein R is an alkyl group containing from 10 to 20 carbon atoms and each R' is a short-chain moiety preferably selected from the group consisting of hydrogen and $C_1$-$C_4$ alkyl and hydroxyalkyl. The $C_{10}$-$C_{18}$ N-alkyl polyhydroxy fatty acid amides can also be used. Typical examples include the $C_{12}$-$C_{18}$ N-methylglucamides. See WO 92/06154. Other sugar-derived nitrogen-containing nonionic emulsifiers include the N-alkoxy polyhydroxy fatty acid amides, such as $C_{10}$-$C_{18}$ N-(3-methoxypropyl)glucamide.

Anionic emulsifier: The structuring system of the present invention must also comprise an anionic emulsifier. This component is present at levels in the range from 0.5% to 10%, preferably from 1% to 5%, more preferably from 1.25% to 3% by weight of the structuring system. By nature, every anionic emulsifier known in the art may be used. However, the compositions of the present invention comprise preferably at least a sulphonic acid emulsifier, such as a linear alkyl benzene sulphonic acid, but water-soluble salt forms may also be used.

Anionic sulfonate or sulfonic acid emulsifiers suitable for use herein include the acid and salt forms of C5-C20, more preferably C10-C16, more preferably C11-C13 alkylbenzene sulfonates, C5-C20 alkyl ester sulfonates, C6-C22 primary or secondary alkane sulfonates, C5-C20 sulfonated polycarboxylic acids, and any mixtures thereof, but preferably C11-C13 alkylbenzene sulfonates.

Anionic sulphate salts or acids emulsifiers suitable for use in the compositions of the invention include the primary and secondary alkyl sulphates, having a linear or branched alkyl or alkenyl moiety having from 9 to 22 carbon atoms or more preferably 12 to 18 carbon atoms.

Also useful are beta-branched alkyl sulphate emulsifiers or mixtures of commercial available materials, having a weight average (of the emulsifier or the mixture) branching degree of at least 50%.

Mid-chain branched alkyl sulphates or sulfonates are also suitable anionic emulsifiers for use in the compositions of the invention. Preferred are the C5-C22, preferably C10-C20 mid-chain branched alkyl primary sulphates. When mixtures are used, a suitable average total number of carbon atoms for the alkyl moieties is preferably within the range of from greater than 14.5 to about 17.5. Preferred mono-methyl-branched primary alkyl sulphates are selected from the group consisting of the 3-methyl to 13-methyl pentadecanol sulphates, the corresponding hexadecanol sulphates, and mixtures thereof. Dimethyl derivatives or other biodegradable alkyl sulphates having light branching can similarly be used.

Other suitable anionic emulsifiers for use herein include fatty methyl ester sulphonates and/or alkyl ethyoxy sulphates (AES) and/or alkyl polyalkoxylated carboxylates (AEC). Mixtures of anionic emulsifiers can be used, for example mixtures of alkylbenzenesulphonates and AES.

The emulsifier surfactants are typically present in the form of their salts with alkanolamines or alkali metals such as sodium and potassium. Preferably, the anionic emulsifiers are neutralized with alkanolamines such as Mono Ethanol Amine or Triethanolamine, and are fully soluble in the liquid phase of the structuring system.

C, Cationic Scavenging Agent—The present compositions comprise as another essential added component a cationic scavenging agent, preferably present at levels of from 0.1% to 50%, more preferably from 0.15% to 25%, and most preferably from 0.2% to 5% by weight of the fabric care compositions. The weight ratio of the cationic scavenging agent to the anionic emulsifier is preferably between 100:1 and 1:1, more preferably between 10:1 and 2:1, and most preferably between 7:1 and 2.5:1.

Cationic scavenging agents suitable for the compositions of the present invention are typically water-soluble and have at least one quaternized nitrogen and one long-chain hydrocarbyl group. Examples of such cationic scavenging agents include the water-soluble alkyltrimethylammonium salts or their hydroxyalkyl substituted analogs, preferably compounds having the formula $R^1R^2R^3R^4N^+X^-$ wherein $R^1$ is $C_8$-$C_{16}$ alkyl, each of $R^2$, $R^3$ and $R^4$ is independently $C_1$-$C_4$ alkyl, $C_1$-$C_4$ hydroxy alkyl, benzyl, and —$(C_2H_4O)_xH$ where x has a value from 2 to 15, preferably from 2 to 8, more preferably from 2 to 5, and X is an anion. Not more than one of $R^2$, $R^3$ or $R^4$ should be benzyl. The preferred alkyl chain length for $R^1$ is $C_{12}$-$C_{15}$. Preferred groups for $R^2$, $R^3$ and $R^4$ are methyl and hydroxyethyl and the anion X may be selected from halide, methosulfate, acetate and phosphate.

Another group of suitable cationic scavenging agents comprises at least one, preferably two or three, more preferably two carbonyl groups:

(1) Preferred quaternary ammonium compounds have the formula $$[(R^5)_{4-m}—\overset{+}{N}—(CH_2)_n—Q—R^6]_m\ X^-] \quad (1)$$

or the formula:

$$\left[(R^5)_{4-m}—\overset{+}{N}—(CH_2)_n—\underset{\underset{Q—R^6}{|}}{CH}—CH_2—Q—R^6]_m\right] X^- \quad (2)$$

wherein Q is a carbonyl unit having the formula:

$$—O—\overset{\overset{O}{\|}}{C}—,\quad —\overset{\overset{O}{\|}}{C}—O—,\quad —O—\overset{\overset{O}{\|}}{C}—O—,$$
$$—\overset{\overset{R^7}{|}}{N}—\overset{\overset{O}{\|}}{C}—,\quad —\overset{\overset{O}{\|}}{C}—\overset{\overset{R^7}{|}}{N}—$$

each $R^5$ is independently hydrogen, $C_1$-$C_6$ alkyl, $C_1$-$C_6$ hydroxyalkyl, and mixtures thereof, preferably methyl or hydroxy alkyl; each $R^6$ unit is independently linear or branched $C_{11}$-$C_{22}$ alkyl, linear or branched $C_{11}$-$C_{22}$ alkenyl, and mixtures thereof, $R^7$ is hydrogen, $C_1$-$C_4$ alkyl, $C_1$-$C_4$ hydroxyalkyl, and mixtures thereof; X is an anion which is compatible with fabric softener actives and adjunct ingredients; the index m is from 1 to 4, preferably 2; the index n is from 1 to 4, preferably 2.

An example of a preferred cationic scavenging agent is a mixture of quaternized amines having the formula:

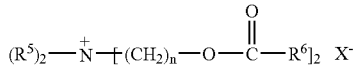

wherein $R^5$ is preferably methyl; $R^6$ is a linear or branched alkyl or alkenyl chain comprising at least 11 atoms, preferably at least 15 atoms. In the above cationic scavenging agent example, the unit $—O_2CR^6$ represents a fatty acyl unit which is typically derived from a triglyceride source. The triglyceride source is preferably derived from tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures of these oils.

The preferred cationic scavenging agents of the present invention are the Diester and/or Diamide Quaternary Ammonium (DEQA) compounds, the diesters and diamides having the formula:

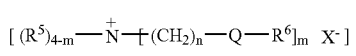

wherein $R^5$, $R^6$ X, and n are the same as defined herein above for formulas (1) and (2), and Q has the formula:

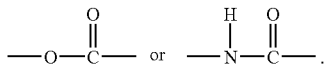

The counterion, $X^{(-)}$ above, can be any cationic scavenging-compatible anion, preferably the anion of a strong acid, for example, chloride, bromide, methylsulfate, ethylsulfate, sulfate, nitrate and the like, more preferably chloride or methyl sulfate. The anion can also, but less preferably, carry a double charge in which case $X^{(-)}$ represents half a group.

Tallow and canola oil are convenient and inexpensive sources of fatty acyl units which are suitable for use in the present invention as $R^6$ units. The following are non-limiting examples of quaternary ammonium compounds suitable for use in the compositions of the present invention. The term "tallowyl" as used herein below indicates the $R^6$ unit is derived from a tallow triglyceride source and is a mixture of fatty acyl units. Likewise, the use of the term canolyl refers to a mixture of fatty acyl units derived from canola oil.

TABLE I

| Cationic scavenging agents |
|---|
| N,N-di(tallowyl-oxy-ethyl)-N,N-dimethyl ammonium chloride; |
| N,N-di(canolyl-oxy-ethyl)-N,N-dimethyl ammonium chloride; |
| N,N-di(tallowyl-oxy-ethyl)-N-methyl, N-(2-hydroxyethyl) ammonium chloride; |
| N,N-di(canolyl-oxy-ethyl)-N-methyl, N-(2-hydroxyethyl) ammonium chloride; |
| N,N-di(2-tallowyloxy-2-oxo-ethyl)-N,N-dimethyl ammonium chloride; |

TABLE I-continued

| Cationic scavenging agents |
|---|
| N,N-di(2-canolyloxy-2-oxo-ethyl)-N,N-dimethyl ammonium chloride |
| N,N-di(2-tallowyloxyethylcarbonyloxyethyl)-N,N-dimethyl ammonium chloride; |
| N,N-di(2-canolyloxyethylcarbonyloxyethyl)-N,N-dimethyl ammonium chloride; |
| N-(2-tallowoyloxy-2-ethyl)-N-(2-tallowyloxy-2-oxo-ethyl)-N,N-dimethyl ammonium chloride; |
| N-(2-canolyloxy-2-ethyl)-N-(2-canolyloxy-2-oxo-ethyl)-N,N-dimethyl ammonium chloride; |
| N,N,N-tri(tallowyl-oxy-ethyl)-N-methyl ammonium chloride; |
| N,N,N-tricanolyl-oxy-ethyl)-N-methyl ammonium chloride; |
| N-(2-tallowyloxy-2-oxoethyl)-N-(tallowyl)-N,N-dimethyl ammonium chloride; |
| N-(2-canolyloxy-2-oxoethyl)-N-(canolyl)-N,N-dimethyl ammonium chloride; |
| 1,2-ditallowyloxy-3-N,N,N-trimethylammoniopropane chloride; and |
| 1,2-dicanolyloxy-3-N,N,N-trimethylammoniopropane chloride; |
| mixtures of the above actives. |

Other examples of quaternary ammonium scavenging agents are methylbis(tallowamidoethyl)(2-hydroxyethyl) ammonium methylsulfate and methylbis(hydrogenatedtallowamidoethyl)(2-hydroxyethyl) ammonium methylsulfate which are available from Witco Chemical Company under the trade names Varisoft® 222 and Varisoft® 110, respectively. Particularly preferred are N,N-di(canolyl-oxy-ethyl)-N,N-dimethyl ammonium chloride and N,N-di(canolyl-oxy-ethyl)-N-methyl, N-(2-hydroxyethyl)ammonium methyl sulfate.

As described hereinbefore, $R^5$ units are preferably methyl, however, suitable cationic scavenging agents are described by replacing the term "methyl" in the above examples in Table I with the units: ethyl, ethoxy, propyl, propoxy, isopropyl, butyl, isobutyl and t-butyl.

The counter ion, X, in the examples of Table I can be suitably replaced by bromide, methyl sulfate, formate, sulfate, nitrate, and mixtures thereof. In fact, the anion, X, is merely present as a counterion of the positively charged quaternary ammonium compounds. The scope of this invention is not considered limited to any particular anion.

One preferred cationic scavenging agent for use in the present invention is a compound derived from the reaction product of (partly) unsaturated fatty acid with triethanolamine, di-methyl sulfate quaternised as described in WO 98/52 907.

Branched chain fatty acids that can be used in the preparation of the DEQA cationic scavenging agent herein and examples of their synthesis are described in WO 97/34 972. DEQA cationic scavenging agents as described herein before and their synthesis are described in WO 97/03 169.

Other DEQA cationic scavenging agents described herein that can be used in the preparation of the composition herein and having desirable levels of unsaturation, and their syntheses, are described in WO 98/03 619 with good freeze/thaw recovery.

Mixtures of actives of structures (1) and (2) may also be used.

(2) Other suitable quaternary ammonium cationic scavenging agent for use herein are cationic nitrogenous salts having two or more long chain acyclic aliphatic $C_8$-$C_{22}$ hydrocarbon groups or one said group and an arylalkyl group which can be used either alone or as part of a mixture are selected having the formula:

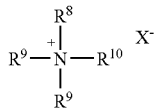

wherein $R^8$ is an acyclic aliphatic $C_8$-$C_{22}$ hydrocarbon group, $R^{10}$ is a $C_1$-$C_4$ saturated alkyl or hydroxyalkyl group, $R^9$ is selected from the group consisting of $R^8$ and $R^{10}$ groups, and $X^-$ is an anion defined as above;

Examples of the above class cationic nitrogenous salts are the well-known dialkyldimethyl ammonium salts such as ditallowdimethyl ammonium chloride, ditallowdimethyl ammonium methylsulfate, di(hydrogenatedtallow)dimethyl ammonium chloride, distearyldimethyl ammonium chloride, dibehenyldimethyl ammonium chloride. Di(hydrogenated-tallow)dimethyl ammonium chloride and ditallowdimethyl ammonium chloride are preferred. Examples of commercially available dialkyldimethyl ammonium salts usable in the present invention are di(hydrogenatedtallow)dimethyl ammonium chloride (trade name Adogen® 442), ditallowdimethyl ammonium chloride (trade name Adogen® 470, Praepagen® 3445), distearyl dimethyl ammonium chloride (trade name Arosurf® TA-100), all available from Witco Chemical Company. Dibehenyldimethyl ammonium chloride is sold under the trade name Kemamine Q-2802C by Humko Chemical Division of Witco Chemical Corporation. Dimethylstearylbenzyl ammonium chloride is sold under the trade names Varisoft® SDC by Witco Chemical Company and Ammonyx® 490 by Onyx Chemical Company.

Mixtures of the above materials can be used in any proportion.

Other suitable cationic scavenging agents cationic bis-alkoxylated amines preferably having the general formula $R^1R^2N^+(A_pR^3)(A_qR^4)X^-$ wherein $R^1$ is an alkyl or alkenyl moiety containing from 8 to 18 carbon atoms, preferably 10 to 16 carbon atoms, most preferably from 10 to 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulphate, sulphate, or the like, sufficient to provide electrical neutrality. A and A' can vary independently and are each selected from C1-C4 alkoxy, especially ethoxy, (i.e., —$CH_2CH_2O$—), propoxy, butoxy and mixtures thereof; p is from 1 to about 30, preferably 1 to about 4 and q is from 1 to about 30, preferably 1 to about 4, and most preferably both p and q are 1.

Most preferred cationic scavenging agents are unsaturated dipalmethyl hydroxyethylammonium methosulfate, bis(s-teroyl oxyethyl)ammonium chloride, dimethyl hydroxyethyl lauryl ammonium chloride and hexadecyl trimethyl ammonium choride.

D, Liquid Carrier—The compositions of the present invention further comprise as added component a liquid carrier. A liquid carrier may also be present when preparing the premixes, e.g. the fabric care premix, the structuring system premix and/or the mixture of all other components, of the present invention. A suitable liquid carrier is selected from the group consisting of water, one or more organic solvents and mixtures thereof. Preferred organic solvents include monohydric alcohols, dihydric alcohols, polyhydric alcohols, glycerol, glycols, polyalkylene glycols such as polyethylene glycol, and mixtures thereof. Highly preferred are mixtures of solvents, especially mixtures of lower aliphatic alcohols such as ethanol, propanol, butanol, isopropanol, and/or diols such as 1,2-propanediol or 1,3-propanediol; or mixtures thereof with glycerol. Suitable alcohols especially include a $C_1$-$C_4$ alcohol. Preferred is 1,2-propanediol or ethanol and mixtures thereof. The liquid carrier is typically present at levels in the range of from 0.1% to 98%, preferably at least from 10% to 95%, more preferably from 25% to 75% by weight of the composition.

Optionally Ingredients:

A, Other surfactants—The present fabric care compositions may optionally comprise at least one additional surfactant selected from the group consisting of nonionic, zwitterionic and amphoteric surfactants and mixtures thereof.

(i) Nonionic Surfactants—Optionally, but highly preferred, the compositions of the present invention comprise at least one nonionic surfactant. If present, the nonionic surfactant is typically present at levels in the range of from 5.0% to 90%, preferably from 7.0% to 50%, more preferably from 10% to 20% by weight of the composition. Essentially any nonionic surfactant in general can be used as disclosed above under the designation of "Nonionic Emulsifiers".

(ii) Zwitterionic Surfactants: Amine Oxide Surfactants—Optionally, but highly preferred, the compositions of the present invention comprise at least one zwitterionic surfactant. If present, the zwitterionic surfactant is typically present at levels in the range of from 1.0% to 50%, preferably from 1.5% to 20%, more preferably from 2.0% to 7.0% by weight of the composition. These surfactants have the formula: $R(EO)_x(PO)_y(BO)_zN(O)(CH_2R')_2.qH_2O$ (I). R is a relatively long-chain hydrocarbyl moiety which can be saturated or unsaturated, linear or branched, and can contain from 8 to 20, preferably from 10 to 16 carbon atoms, and is more preferably C12-C16 primary alkyl. R' is a short-chain moiety preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

(iii) Amphoteric Surfactants—Amine and Amide Functional Detersive Surfactants—Optionally, but highly preferred, the compositions of the present invention comprise at least one amphoteric surfactant. If present, the amphoteric surfactant is typically present at levels in the range of from 1.0% to 50%, preferably from 1.5% to 20%, more preferably from 2.0% to 7.0% by weight of the composition. A preferred group of these surfactants are amine surfactants, preferably an amine surfactant having the formula $RX(CH_2)_xNR^2R^3$ wherein R is $C_6$-$C_{12}$ alkyl; X is a bridging group which is selected from NH, CONH, COO, or O or X can be absent; x is from 2 to 4; $R_2$ and $R_3$ are each independently selected from H, $C_1$-$C_4$ alkyl, or ($CH_2$—$CH_2$—$O(R_4)$) wherein $R_4$ is H or methyl. Particularly preferred surfactants of this type include those selected from the group consisting of decyl amine, dodecyl amine, $C_8$-$C_{12}$ bis(hydroxyethyl)amine, $C_8$-$C_{12}$ bis(hydroxypropyl)amine, $C_8$-$C_{12}$ amido propyl dimethyl amine, and mixtures thereof.

This group of surfactants also includes fatty acid amide surfactants having the formula $RC(O)NR'_2$ wherein R is an alkyl group containing from 10 to 20 carbon atoms and each R' is a short-chain moiety preferably selected from the group consisting of hydrogen and $C_1$-$C_4$ alkyl and hydroxyalkyl. The $C_{10}$-$C_{18}$ N-alkyl polyhydroxy fatty acid amides can also be used. Typical examples include the $C_{12}$-$C_{18}$ N-methylglucamides. See WO 92/06154. Other sugar-derived nitrogen-containing nonionic surfactants include the N-alkoxy polyhydroxy fatty acid amides, such as $C_{10}$-$C_{18}$ N-(3-methoxypropyl)glucamide.

B, Builder—Optionally, but highly preferred, the compositions of the present invention comprise at least one builder. If present, the builder is typically present at levels in the range of from 1.0% to 50%, preferably from 2.0% to 30%, more preferably from 3.0% to 10% by weight of the composition.

In general any known builder is useful herein, including inorganic types such as zeolites, layer silicates, and phosphates such as the alkali metal polyphosphates, and organic types including especially the alkali metal salts of citrate, 2,2-oxydisuccinate, carboxymethyloxysuccinate, nitrilotriacetate and the like. Phosphate-free, water-soluble organic builders which have relatively low molecular weight, e.g., below about 1,000, are highly preferred for use herein. Other suitable builders include sodium carbonate and sodium silicates having varying ratios of $SiO_2$:$Na_2O$ content, e.g., 1:1 to 3:1 with 2:1 ratio being typical.

C, Enzymes—Optionally the compositions of the present invention comprise one or more enzymes. If present, the enzyme is typically present at levels in the range of from 0.0001% to 5%, preferably at least from 0.0002% to 1.5%, and more preferably from 0.0005% to 0.1% of active material by weight of the composition. When enzymes are present, they can be used at very low levels, e.g., from 0.001% or lower, in certain embodiments of the invention; or they can be used in heavier-duty laundry detergent formulations in accordance with the invention at higher levels, e.g., 0.02% and higher.

Suitable enzymes for use herein include protease, amylase, cellulase, mannanase, endoglucanase, lipase and mixtures thereof. Enzymes can be used at their art-taught levels, for example at levels recommended by suppliers such as Novo and Genencor. In accordance with a preference of some consumers for "non-biological" detergents, the present invention includes both enzyme-containing and enzyme-free embodiments.

D, Suds Suppressing System—Optionally the compositions of the present invention comprise a suds suppressing system. If present, the suds compressing system is typically present at a level less than 10%, preferably 0.001% to 10%, preferably from 0.01% to 8%, most preferably from 0.05% to 5%, by weight of the composition.

Suitable suds suppressing systems for use herein may comprise essentially any known antifoam compound or mixture. Suitable suds suppressors can include low solubility components such as highly crystalline waxes and/or hydrogenated fatty acids, or more sophisticated compounded suds suppressor combinations, for example those commercially available from companies such as Dow Corning. More soluble antifoams include for example the lower 2-alkyl alkanols such as 2-methyl-butanol.

E, Coupling agent—Optionally the compositions of the present invention comprise a coupling agent. If present, the coupling agent is typically present at a level of from 0.1% to 20%, more typically 0.5% to 5% by weight of the composition.

Coupling agents suitable for use herein include fatty amines other than those which have marked surfactant character or are conventional solvents (such as the lower alkanolamines). Examples of these coupling agents include hexylamine, octylamine, nonylamine and their C1-C3 secondary and tertiary analogs.

A particularly useful group of coupling agents is selected from the group consisting of molecules which consist of two polar groups separated from each other by at least 5, preferably 6, aliphatic carbon atoms; preferred compounds in this group are free from nitrogen and include 1,4 Cyclo Hexane Di Methanol (CHDM), 1,6 Hexanediol, 1,7 Heptanediol and mixtures thereof. 1,4 Cyclo Hexane Di Methanol may be present in either its cis configuration, its trans configuration or a mixture of both configurations.

F, Fabric substantive perfume—Optionally the compositions of the present invention comprise one or more fabric substantive perfume to provide a "scent signal" in the form of a pleasant odor which provides a freshness impression to the fabrics. If present, the fabric substantive perfumes are present at levels in the range from 0.0001% to 10% by weight of the composition.

The fabric substantive perfume ingredients are characterized by their boiling points (B.P.). The fabric substantive perfume ingredients have a B.P, measured at the normal, standard pressure of 760 mm Hg, of 240° C. or higher, and preferably of 250° C. or higher. Preferably the fabric substantive perfume ingredients have a ClogP of greater than 3, more preferably from 3 to 6.

The preferred compositions used in the present invention contain at least 2, preferably at least 3, more preferably at least 4, even more preferably at least 5, even more preferably at least 6, and even more preferably at least 7 different fabric substantive perfume ingredients. Most common perfume ingredients which are derived from natural sources are composed of a multitude of components. When each such material is used in the formulation of the preferred perfume compositions of the present invention, it is counted as one single ingredient, for the purpose of defining the invention.

Nonlimiting examples of suitable fabric substantive perfumes suitable for use in the compositions of the present invention are disclosed in WO 02/18528.

G, Chelant—Optionally the compositions of the present invention comprise one or more chealants. If present, chelants are present typically at levels lower than 5%, more typically, at levels of from 0.01% to 3%.

Suitable chelants for use herein include nitrogen-containing, P-free aminocarboxylates such as EDDS, EDTA and DTPA; aminophosphonates such as diethylenetriamine pentamethylenephosphonic acid and, ethylenediamine tetramethylenephosphonic acid; nitrogen-free phosphonates e.g., HEDP; and nitrogen or oxygen containing, P-free carboxylate-free chelants such as compounds of the general class of certain macrocyclic N-ligands such as those known for use in bleach catalyst systems.

H, Mixtures of adjuncts—Mixtures of the above components can be made in any proportion.

I, Other adjuncts—Examples of other suitable cleaning adjunct materials include, but are not limited to, alkoxylated benzoic acids or salts thereof such as trimethoxy benzoic acid or a salt thereof (TMBA), conventional (not fabric substantive) perfumes and pro-perfumes, bleaches, bleach activators, bleach catalysts, enzyme stabilizing systems, e.g. boric acid and/or calcium chloride; optical brighteners or fluorescers, soil release polymers, dispersants or polymeric organic builders including water-soluble polyacrylates, acrylate/maleate copolymers and the like, dyes, colorants, filler salts such as sodium sulfate, hydrotropes such as toluenesulfonates, cumenesulfonates and naphthalenesulfonates, photoactivators, hydrolyzable surfactants, preservatives, anti-oxidants, anti-shrinkage agents, anti-wrinkle agents, germicides, fungicides, color speckles, colored beads, spheres or extrudates, sunscreens, fluorinated compounds, clays, pearlescent agents, luminescent agents or chemiluminescent agents, anti-corrosion and/or appliance protectant agents, alkalinity sources or other pH adjusting agents, solubilizing agents, carriers, processing aids, pigments, free radical scavengers, and pH control agents. Suitable materials include those described in U.S. Pat. Nos. 5,705,464; 5,710,115; 5,698,504; 5,695,679; 5,686,014 and 5,646,101 and in WO 02/40 627.

Process for Preparing Fabric Treatment Compositions

The liquid fabric treatment compositions of the present invention can be prepared in any suitable manner and can, in general, involve any order of mixing or addition of the specified added components. However, it has been discovered that there exists a certain preferred way to accomplish such a preparation.

The first step involves the preparation of a premix comprising the cationic fabric care ingredient and the liquid carrier. Optionally, it may be desirable to add the cationic scavenging agent at this point to the premix. The second step involves the preparation of a second premix comprising the structuring system. This structuring system comprises the structuring agent, the nonionic emulsifier and the anionic emulsifier and optionally a liquid carrier. The third step involves the preparation of a mixture comprising all optional components, optionally in the presence of a liquid carrier. It may be desirable to add to this mixture the cationic scavenging agent. The last step involves the combination of all premixes and mixtures cited above.

In the process for preparing the fabric treatment composition of the present invention, the cationic scavenging agent is added either to the fabric care premix or to the other component mixture or a combination thereof.

This process for preparing the structured liquid fabric treatment composition of the present invention is preferably assisted by use of conventional high-shear mixing means. This ensures proper dispersion of the ingredients throughout the final composition.

The fabric care compositions herein are described with respect to their components as added. Such components may, of course, react or otherwise change form once the compositions are prepared and all components have been combined.

Forms and Types of the Compositions

The structured liquid fabric treatment composition of the present invention may be in any form, such as liquids (aqueous or non-aqueous), pastes, and gels. Encapsulated and/or unitized dose compositions are included, as are compositions, which form two or more separate but combined dispensable portions. The liquid compositions can also be in a "concentrated" or diluted form. More preferred liquid fabric treatment compositions of the present invention include heavy duty liquid fabric treatment compositions and liquid laundry detergents for washing 'standard', non-fine fabrics as well as fine fabrics including silk, wool and the like. Compositions formed by mixing the provided compositions with water in widely ranging proportions are included. In case that the structured liquid fabric treatment composition of the present invention is in form of a non-aqueous liquid fabric treatment composition the composition is suitable to be incorporated into a water-soluble film, e.g. a polyvinylalcohol-containing film.

The structured liquid fabric treatment composition of the present invention may also be present in form of a rinse-added composition for delivering fabric care benefits, i.e., in form of a rinse-added fabric-softening composition, or in form of a rinse-added fabric finishing composition, or in form of a rinse-added wrinkle-reduction composition.

The liquid fabric treatment compositions of the present invention may be in the form of spray compositions, preferably contained within a suitable spray dispenser. The present invention also includes products in a wide range of types such as single-phase compositions, as well as dual-phase or even multi-phase compositions. The liquid fabric treatment compositions of the present invention may be incorporated and stored in a single-, dual-, or multi-compartment bottle.

Method of Treating Fabrics and Uses of Compositions of the Invention in Relation to Form A method of treating a substrate comprising the steps of contacting the substrate with the structured liquid fabric treatment composition of the present invention is incorporated in the present invention. As used herein, "structured liquid fabric treatment compositions" include fabric treatment compositions and liquid laundry detergent compositions for handwash, machine wash and other purposes including fabric care additive compositions and compositions suitable for use in the soaking and/or pretreatment of stained fabrics.

If used as a liquid fabric care product, e.g., a fabric softening product, the compositions can be used to form aqueous fabric treatment baths containing from 500 ppm to 5.000 ppm of the fabric treatment compositions. If used as a liquid laundry detergent product, the compositions can be used to form aqueous washing liquor containing from 5.000 ppm to 20.000 ppm of the liquid laundry detergent compositions.

It has been found that the combination of the above-cited ingredients within a structured liquid fabric treatment composition provides superior fabric care benefits, including, according to the specific embodiment, one or more aspects of superior fabric care or garment care as exemplified by one or more of: superior garment appearance; excellent tactile characteristics, superior fabric feel; fabric softness; reduction, removal or prevention of creases or wrinkles in garments; color care; superior ease of ironing; garment shape retention and/or shape recovery; and fabric elasticity. Moreover the invention has other advantages, depending on the precise embodiment, which include superior formulation flexibility and/or formulation stability of the home laundry compositions provided.

EXAMPLES

The following non-limiting examples are illustrative of the present invention. Percentages are by weight unless otherwise specified.

Example (1)

Structured Heavy Liquid Detergent Composition, Prepared According to the Process of the Present Invention The final fabric treatment compositions are formulated by combining three distinctive premixes: 81 g of fabric cleaning premix (A1), 14 g of structuring system premix (B1), and 5 g fabric care premix (C1) as set forth herein below. A second fabric treatment composition is obtained by combining 81 g of fabric cleaning premix (A2), 14 g of structuring premix B2 and 5 g of fabric care premix C2.

Fabric Cleaning Premix (A):

| | Wt % in Formula A1 | Wt % in Formula A2 |
|---|---|---|
| C12-14 amineoxide | — | 5.0 |
| Neodol 45-7 (1) | 15.0 | 15.0 |
| Citric acid | 5.0 | 5.0 |
| Ethoxylated tetraethylene pentamine | 1.0 | 1.0 |
| Hydroxyethane dimethylene phosphonic acid | 0.4 | 0.3 |
| Boric acid | 2.0 | 3.0 |
| $CaCl_2$ | 0.04 | 0.03 |
| Propanediol | 10.0 | 10.0 |
| Ethanol | 0.8 | 0.6 |
| Monoethanolamine | to pH 7.0-8.0 | to pH 7.0-8.0 |
| Protease enzyme (raw material) | 1.0 | 0.80 |
| Amylase enzyme (raw material) | 0.40 | 0.32 |
| Cellulase enzyme (raw material) | 0.02 | 0.01 |
| Mannanase enzyme (raw material) | 0.08 | 0.06 |
| Suds suppressor | 0.4 | 0.2 |
| Dye | 0.002 | 0.003 |
| Perfume | 0.4 | 0.8 |
| C13-15 hydroxyethyl dimethyl ammonium chloride | — | 1.5 |
| Water | Balance to 100 | Balance to 100 |

Structuring System Premix (B):

| | Wt % in Formula B1 | Wt % in Formula B2 |
|---|---|---|
| Hydrogenated castor oil | 4.5 | 6.0 |
| C13-15 alkylbenzene sulphonic acid | 2.0 | 1.7 |
| Neodol 45-7 (1) | — | 30 |
| C12-14 amineoxide | 40 | — |
| Boric acid | 0.37 | 0.51 |
| NaOH | 0.45 | 0.28 |
| Water | Balance to 100 | Balance to 100 |

Fabric Care premix (C):

| | Wt % in Formula C1 | Wt % in Formula C2 |
|---|---|---|
| C13-15 hydroxyethyl dimethyl ammonium chloride | 1.0 | — |
| Cationic silicone solution (2) | 25.0 | 18.6 |
| C12-14 amineoxide | 10.0 | 3.2 |
| Neodol 25-3 (3) | 6.0 | 6.0 |
| Ethanol | 6.5 | 4.7 |
| Water | Balance to 100 | Balance to 100 |

(1) Neodol 45-7: $C_{14}$, and $C_{15}$ alcohol ethoxylated with 7 eq. moles of ethylene oxide on average (Neodol ® 45-AE 7) ex Shell.
(2) Cationic silicone structure as in structure 2a: (i) with: $R^1$, $R^3$ = $CH_3$, $R^2$ = —O—$(CH_2)_3$, X = $CH_2CHOHCH_2$, a = 2; b = 0; c = 150; d = 0; cationic divalent moiety: ii(a) with $R^4$, $R^5$, $R^6$, $R^7$ all $CH_3$ and $Z^1$ is $(CH_2)_6$. A = 50% by weight of acetate, 50% by weight of laurate, m = 2; polyalkyleneoxide moiety (iii) is$NH_2CH(CH_3)CH_2O(C_2H_4O)_{38}(C_3H_6O)_6CH_2CH(CH_3)NH_2$; cationic monovalent moiety iv(i) has $R^{12}$, $R^{13}$ and $R^{14}$ all methyl. The cationic silicone is present as a 72.1 wt.-% solution in ethanol.
(3) Neodol 25-3: $C_{12}$, and $C_{15}$ alcohol ethoxylated with 3 eq. moles of ethylene oxide on average (Neodol ® 25-AE 3) ex Shell.

Example (2)

Structured Rinse Added Softener Composition, Prepared According to the Process of the Present Invention The final rinse added fabric treatment compositions are formulated by combining two distinctive premixes: 25 g of structuring premix D1 as below and 12 g of a fabric care premix E1; 25 g of structuring premix D2 as below and 12 g of a fabric care premix E2; 25 g of structuring premix D3 as below and 12 g of a fabric care premix E3.

Structuring System Premix (D):

| | Wt % in Formula D1 | Wt % in Formula D2 | Wt % in Formula D3 |
|---|---|---|---|
| Hydrogenated castor oil | 7.5 | 6.0 | 5.5 |
| C13-15 alkylbenzene sulphonic acid | 2.3 | 2.5 | 3.0 |
| Neodol 45-7 (1) | 14.5 | 11 | — |
| C12-14 amineoxide | — | 15 | 8 |
| Boric acid | 0.58 | 0.42 | 0.35 |
| NaOH | 0.85 | 0.71 | 0.92 |
| Water | Balance to 100 | Balance to 100 | Balance to 100 |

Fabric Care Premix (E):

| | Wt % in Formula E1 | Wt % in Formula E2 | Wt % in Formula E3 |
|---|---|---|---|
| Diester of tallow fatty acid and diethanol dimethyl ammonium chloride | — | 18 | 10.0 |
| C13-15 hydroxyethyl dimethyl ammonium chloride | 2.3 | 1.0 | — |
| C12-14 amineoxide | 10.0 | 8.0 | 7.5 |
| Cationic silicone solution (2) | 12 | — | 5.8 |
| Neodol 25-3 (3) | 2.5 | — | 5.2 |
| Water | Balance to 100 | Balance to 100 | Balance to 100 |

There is a preferred way of preparing the structuring premixes of the present invention such as described above in examples 1 and 2. The preferred premix preparation process comprises the following steps:

(1) Dissolving the anionic emulsifier in water, preferably in demineralized water;

(2) Adding the nonionic emulsifier;

(3) Optionally, but preferably, heating up the mixture, preferably to a temperature above the melting point of the structuring agent;

(4) Adding the structuring agent;

(5) Allowing the mixture to emulsify, preferably either by stirring, preferably for approximately one hour or more preferably by mixing under high shear mixing conditions for less than one hour, preferably for less than 30 minutes;

(6) Optionally, but preferably, cooling the emulsion down to a temperature, preferably to a temperature below the melting point of the structuring agent, more preferably between 15° C. and 90° C., even more preferably between 20° C. and 70° C., and most preferably between 30° C. and 50° C.; preferably at a constant cooling rate of at least at least 1° C./min., more preferably of at least 1.5° C./min., even more preferably of at least 2.0° C./min., and most preferably not exceeding 2.5° C./min.

The following non-limiting example is illustrative and non-limiting for the premix preparation process of the present invention.

Example (3)

Preparation of the Structuring Premixes 2.0 g of C13-C15 alkylbenzene sulphonic acid are placed in 53.5 g of demineralized water under stirring. 40 g of C12-C14 amineoxide are added. The mixture is then heated up to 90° C. to 95° C.

4.5 g of hydrogenated castor oil are added. The mixture is then allowed to emulsify either by mixing for approximately one hour or by high shear mixing for approximately 15 minutes. The particle size distribution observed at the stage is typically between 10 μm and 15 μm (via Lasentec measurement).

The emulsion is than cooled down to a temperature of 65° C. via a heat exchanger with a cooling rate of 1.5° C./min.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A structured liquid fabric treatment composition comprising as added components (A) one or more silicone-based cationic fabric care ingredients;

(B) a structuring system comprising a structuring agent, a nonionic emulsifier and an anionic emulsifier, wherein the structuring agent comprises hydrogenated castor oil;

(C) or more cationic scavenging agents for said anionic emulsifier, wherein the cationic scavenging agent comprises a compound selected from the group consisting of:

(1)

$$R^1R^2R^3R^4N^+X^-$$

(2)

$$[(R^5)_{4-m}-\overset{+}{N}-(CH_2)_n-Q-R^6]_m\ X^-]$$

-continued (3)

$$\left[(R^5)_{4-m}-\overset{+}{N}-(CH_2)_n-\underset{\underset{Q-R^6}{|}}{CH}-CH_2-Q-R^6]_m\right]\ X^-$$

(4)

$$R^9-\overset{\overset{R^8}{|}}{\underset{\underset{R^9}{|}}{\overset{+}{N}}}-R^{10}\ X^-$$

(5) and mixtures thereof;

wherein $R^1$ is $C_{8-16}$ alkyl, each of $R^2$, $R^3$ and $R^4$ is independently selected from the group consisting of $C_{1-4}$ alkyl; $C_{1-4}$ hydroxy alkyl; benzyl; $-(C_2H_4O)_xH$, where x is from about 2 to about 5, and mixtures thereof; wherein Q is a carbonyl unit having the formula:

$$-O-\overset{\overset{O}{\|}}{C}-,\quad -\overset{\overset{O}{\|}}{C}-O-,\quad -O-\overset{\overset{O}{\|}}{C}-O-,$$

$$-\overset{\overset{R^7}{|}}{N}-\overset{\overset{O}{\|}}{C}-,\quad -\overset{\overset{O}{\|}}{C}-\overset{\overset{R^7}{|}}{N}-$$

$R^5$ is independently selected from the group consisting of hydrogen, $C_{1-6}$ alkyl, $C_{1-6}$ hydroxyalkyl, and mixtures thereof; each $R^6$ is independently selected from the group consisting of linear or branched $C_{11-22}$ alkyl, linear or branched $C_{11-22}$ alkenyl, and mixtures thereof; $R^7$ is independently selected from the group consisting of hydrogen, $C_{1-4}$ alkyl, $C_{1-4}$ hydroxyalkyl, and mixtures thereof; the index m is from about 1 to about 4; the index n is from about 1 to about 4; wherein $R^8$ is an acyclic aliphatic $C_{8-22}$ hydrocarbon group; $R^9$ is a $C_{1-4}$ saturated alkyl or hydroxyalkyl group, $R^{10}$ is selected from the group consisting of $R^8$ and $R^9$ groups; and mixtures thereof, and wherein X is a compatible anion, selected from the group consisting of halide, methosulfate, acetate, phosphate and mixtures thereof; and (D) a liquid carrier.

2. A structured liquid fabric treatment composition according to claim 1, wherein the silicone-based cationic fabric care ingredient is selected from the group consisting of cationic silicone polymers comprising one or more polysiloxane units and one or more quaternary nitrogen units, and mixtures thereof.

3. A structured liquid fabric treatment composition according to claim 2 wherein the cationic silicone polymer has the formula:

$$\left[Z-X-(OC_aH_{2a})_b-R^2-\left(\underset{\underset{R^1}{|}}{\overset{\overset{R^1}{|}}{SiO}}\right)_c-\left(\underset{\underset{R^3}{|}}{\overset{\overset{R^1}{|}}{SiO}}\right)_d-\underset{\underset{R^1}{|}}{\overset{\overset{R^1}{|}}{Si}}-R^2-(C_aH_{2a}O)_b-X-Z\right]^n\ nA$$

wherein:

$R^1$ is independently selected from the group consisting of $C_{1-22}$ alkyl, $C_{2-22}$ alkenyl, $C_{6-22}$ alkylaryl, aryl, cycloalkyl and mixtures thereof;

$R^2$ is independently selected from the group consisting of divalent organic moieties;

X is independently selected from the group consisting of ring-opened epoxides;

$R^3$ is independently selected from polyether groups having the formula:

$$-M^1(C_aH_{2a}O)_b-M^2$$

wherein $M^1$ is a divalent hydrocarbon residue; $M^2$ is independently selected from the group consisting of H, $C_{1-22}$ alkyl, $C_{2-22}$ alkenyl, $C_{6-22}$ alkylaryl, aryl; cycloalkyl, $C_{1-22}$ hydroxyalkyl, polyalkyleneoxide, (poly)alkoxy alkyl, and mixtures thereof;

Z is independently selected from the group consisting of monovalent organic moieties comprising at least one quaternized nitrogen atom;

a is from about 2 to about 4; b is from 0 to about 100; c is from about 1 to about 1000; d is from 0 to about 100; n is the number of positive charges associated with the cationic silicone polymer, which is greater than or equal to about 2; and A is a monovalent anion.

4. A structured liquid fabric treatment composition according to claim 3 wherein wherein Z is independently selected from the group consisting of:

(i)

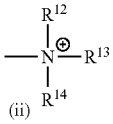

(ii)

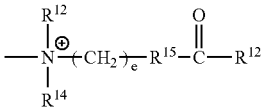

(iii)

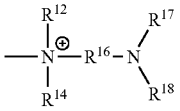

(iv)

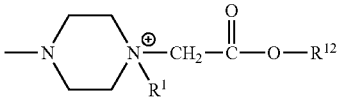

(v) monovalent aromatic or aliphatic heterocycic group, substituted or unsubstituted, containing at least one quaternized nitrogen atom wherein:

$R^{12}$, $R^{13}$, $R^{14}$ are the same or different, and are selected from the group consisting of $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl, and mixtures thereof;

$R^{15}$ is —O— or $NR^{19}$;

$R^{16}$ is a divalent hydrocarbon residue;

$R^{17}$, $R^{18}$, $R^{19}$ are the same or different, and are selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide, (poly)alkoxy alkyl and mixtures thereof; and e is from about 1 to about 6.

5. A structured liquid fabric treatment composition according to claim 2 wherein the cationic silicone polymer is composed of alternating units of:

(i) a polysiloxane of the following formula:

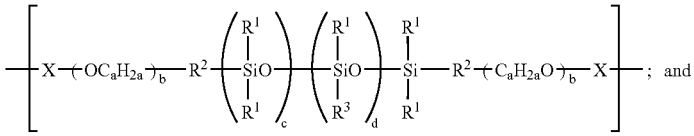

(ii) a divalent organic moiety comprising at least two quaternized nitrogen atoms;

wherein:

$R^1$ is independently selected from the group consisting of $C_{1-22}$ alkyl, $C_{2-22}$ alkenyl, $C_{6-22}$ alkylaryl, aryl, cycloalkyl and mixtures thereof;

$R^2$ is independently selected from the group consisting of divalent organic moieties;

X is independently selected from the group consisting of ring-opened epoxides;

$R^3$ is independently selected from polyether groups having the formula:

$$-M^1(C_aH_{2a}O)_b-M^2$$

wherein $M^1$ is a divalent hydrocarbon residue; $M^2$ is independently selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof;

a is from about 2 to about 4; b is from 0 to about 100; c is from about 1 to about 1000; and d is from 0 to about 100.

6. A structured liquid fabric treatment composition according to claim 2 wherein the cationic silicone polymer is composed of alternating units of:

(i) a polysiloxane of the following formula:

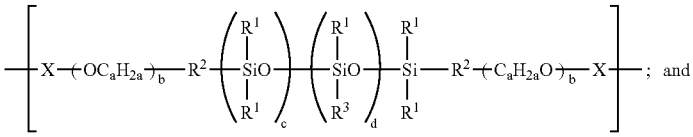

; and (ii) a cationic divalent organic moiety selected from the group consisting of:

(a)

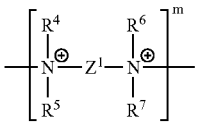

2mA;

(b)

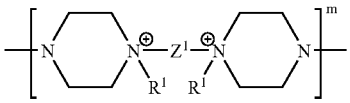

2mA;

(c)

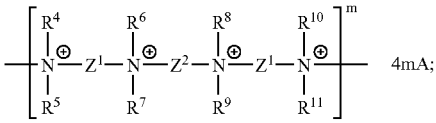

4mA;

(d) a divalent aromatic or aliphatic heterocycic group, substituted or unsubstituted, containing at least one quaternized nitrogent atom and (iii) optionally, a polyalkyleneoxide of formula:

$[Y—O—(C_aH_{2a}O)_b—Y]$; and (iv) optionally, a cationic monovalent organic moiety, to be used as an end-group, selected from the group consisting of:

(i)

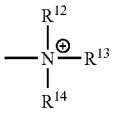

(ii)

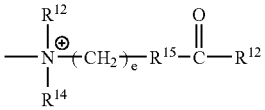

(iii)

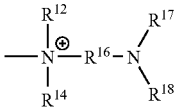

-continued (iv)

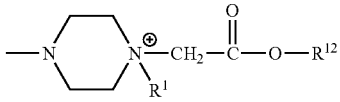

(v) monovalent aromatic or aliphatic heterocycic group, substituted or unsubstituted, containing at least one quaternized nitrogen atom;

wherein:

$R^4$, $R^5$, $R^6$, $R^7$, $R^8$, $R^9$, $R^{10}$, $R^{11}$ are the same or different, and are selected from the group consisting of $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl and mixtures thereof; or in which $R^4$ and $R^6$, or $R^5$ and $R^7$, or $R^8$ and $R^{10}$, or $R^9$ and $R^{11}$ are components of a bridging alkylene group;

$R^{12}$, $R^{13}$, $R^{14}$ are the same or different, and are selected from the group consisting of $C_{1-22}$ alkyl; $C_{2-22}$ alkenyl; $C_{6-22}$ alkylaryl; $C_{1-22}$ hydroxyalkyl; polyalkyleneoxide; (poly)alkoxy alkyl groups and mixtures thereof; and $R^{15}$ is —O— or $NR^{19}$;

$R^{16}$ and $M^1$ are the same or different divalent hydrocarbon residues;

$R^{17}$, $R^{18}$, $R^{19}$ are the same or different, and are selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide, (poly)alkoxy alkyl, and mixtures thereof; and $Z^1$ and $Z^2$ are the same or different divalent hydrocarbon groups with at least 2 carbon atoms;

Y is a secondary or tertiary amine;

a is from about 2 to about 4; b is from 0 to about 100; c is from about 1 to about 1000; d is from 0 to about 100; e is from about 1 to about 6; m is the number of positive charges associated with the cationic divalent organic moiety, which is greater than or equal to about 2; and A is an anion.

7. A structured liquid fabric treatment composition according to claim 1, wherein the silicone-based cationic fabric care ingredient is present at a level of from about 0.1% to about 20% by weight of the composition.

8. A structured liquid fabric treatment composition according to claim 7, wherein the silicone-based cationic fabric care ingredient is present at a level of from about 0.2% to about 2.5% by weight of the composition.

9. A structured liquid fabric treatment composition according to claim 1, wherein said structuring system is present at a level of from about 0.1% to about 20% by weight of the composition, and wherein said structuring system comprises at least 0.5%, by weight of the structuring system, of the anionic emulsifier.

10. A structured liquid fabric treatment composition according to claim 9, wherein said structuring system is present at a level of from about 0.2% to about 5.0% by weight of the composition.

11. A structured liquid fabric treatment composition according to claim 1, wherein said cationic scavenging agent is present at a level of from about 0.1% to about 50% by weight of the composition.

12. A structured liquid fabric treatment composition according to claim 11, wherein said cationic scavenging agent is present at a level of from about 0.2% to about 10% by weight of the composition.

13. A structured liquid fabric treatment composition according to claim 1, wherein said liquid carrier is present at a level of from about 0.1% to about 98% by weight of the composition.

14. A structured liquid fabric treatment composition according to claim 13, wherein said liquid carrier is present at a level of from about 25% to about 75% by weight of the composition.

15. A structured liquid fabric treatment composition according to claim 1 wherein the nonionic emulsifier is selected from the group consisting of alkoxylated nonionic emulsifiers, amidofunctional nonionic emulsifiers, condensation products of primary aliphatic alcohols with from about 1 to about 75 moles of $C_{2-3}$ alkylene oxide, and from semi-polar emulsifiers having the formula:

$$R(EO)_x(PO)_y(BO)_zN(O)(CH_2R')_2$$

and mixtures thereof, wherein R is a saturated or unsaturated, linear or branched $C_{8-20}$ hydrocarbyl moiety; R' is a $C_{1-4}$ hydrocarbyl moiety; and x, y, z are each from 0 to about 100; EQ is ethyleneoxy, PO is propyleneoxy and BO is butyleneoxy, and wherein the anionic emulsifier of said structuring system is selected from the group consisting of $C_{5-20}$ alkylbenzene sulfonates, $C_{5-20}$ alkyl ester sulfonates, $C_{6-22}$ primary or secondary alkane sulfonates, $C_{5-20}$ sulfonated polycarboxylates, $C_{5-20}$ alkylbenzene sulfonic acids, $C_{5-20}$ alkyl ester sulfonic acids, $C_{6-22}$ primary or secondary alkane sulfonic acids, $C_{5-20}$ sulfonated polycarboxylates acids and mixtures thereof.

16. A structured liquid fabric treatment composition according to claim 1 wherein in the structuring system component the weight ratio of the nonionic emulsifier to the anionic emulsifier is from about 9:1 to about 4:1.

17. A structured liquid fabric treatment composition according to claim 1 wherein the weight ratio of the cationic scavenging agent to the anionic emulsifier is from about 5:1 to about 2.5:1.

18. A structured liquid fabric treatment composition according to claim 1, wherein the liquid carrier is selected from the group consisting of water, one or more organic solvents and mixtures thereof.

19. A structured liquid fabric treatment composition according to claim 1 further comprising one or more components selected from the group consisting of nonionic surfactants, zwitterionic surfactants, amphoteric surfactants, builders, perfumes, suds suppressors, enzymes, coupling agents, chelants and mixtures thereof.

20. Process for preparing a structured liquid fabric treatment composition according to claim 1 comprising the steps of:

(i) premixing the fabric care ingredient with the liquid carrier, optionally in the presence of the cationic scavenging agent;

(ii) premixing the structuring system, optionally in the presence of a liquid carrier;

(iii) optionally, if present, preparing a mixture of all other components; optionally in the presence of the cationic scavenging agent; and (iv) combining all said premixes, wherein the cationic scavenging agent is added either to the fabric care premix or to the other component mixture or a combination thereof.

21. A method for imparting a fabric care benefit to a fabric substrate, wherein said benefit is selected from the group consisting of fabric cleaning benefit, reduction of wrinkles benefit, prevention of wrinkles benefit, surrender of fabric feel benefit, shape retention benefit, shape recovery benefit, fabric elasticity benefit, ease of ironing benefit, perfume benefit, fabric softening benefit, color benefit, and mixtures thereof, the method comprising contacting the fabric substrate with the structured liquid fabric treatment composition according to claim 1.

22. A structured liquid fabric treatment composition according to claim 21 wherein wherein Z is independently selected from the group consisting of:

(i)

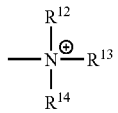

(ii)

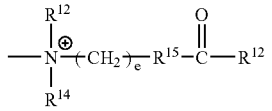

(iii)

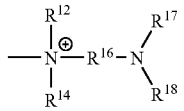

(iv)

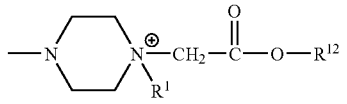

(v) monovalent aromatic or aliphatic heterocycic group, substituted or unsubstituted, containing at least one quaternized nitrogen atom wherein:

$R^{12}$, $R^{13}$, $R^{14}$ are the same or different, and are selected from the group consisting of $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl, and mixtures thereof;

$R^{15}$ is —O— or $NR^{19}$;

$R^{16}$ is a divalent hydrocarbon residue;

$R^{17}$, $R^{18}$, $R^{19}$ are the same or different, and are selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide, (poly)alkoxy alkyl and mixtures thereof; and e is from about 1 to about 6.

23. A structured liquid fabric treatment composition comprising as added components (A) one or more silicone-based cationic fabric care ingredients having the formula;

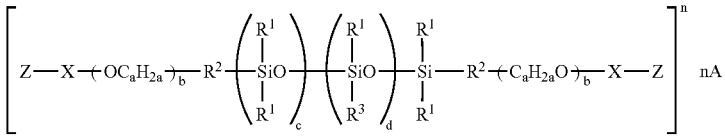

wherein:

$R^1$ is independently selected from the group consisting of $C_{1-22}$ alkyl, $C_{2-22}$ alkenyl, $C_{6-22}$ alkylaryl, aryl, cycloalkyl and mixtures thereof;

R is independently selected from the group consisting of divalent organic moieties;

X is independently selected from the group consisting of ring-opened epoxides;

$R^3$ is independently selected from polyether groups having the formula:

$-M^1(CaH_2aO)_b-M^2$ wherein $M^1$ is a divalent hydrocarbon residue; $M^2$ is independently selected from the group consisting of H, $C_{1-22}$ alkyl, $C_{2-22}$ alkenyl, $C_{6-22}$ alkylaryl, aryl; cycloalkyl, $C_{1-22}$ hydroxyalkyl, polyalkyleneoxide, (poly)alkoxy alkyl, and mixtures thereof;

Z is independently selected from the group consisting of monovalent organic moieties comprising at least one quaternized nitrogen atom;

a is from about 2 to about 4; b is from 0 to about 100; c is from about 1 to about 1000; d is from 0 to about 100; n is the number of positive charges associated with the cationic silicone polymer, which is greater than or equal to about 2; and A is a monovalent anion;

(B) a structuring system comprising a structuring agent, a nonionic emulsifier and an anionic emulsifier, wherein the structuring agent is selected from the group consisting of crystalline, hydroxyl containing stabilizing agents, fatty acids, fatty esters and fatty soap water-insoluble wax-like substances, and mixtures thereof;

(C) one or more cationic scavenging agents for said anionic emulsifier; wherein the cationic scavenging agent comprises a compound selected from the group consisting of:

(1)

$R^1R^2R^3R^4N^+X^-$ (2)

$[(R^5)_{4-m}-\overset{+}{N}-(CH_2)_n-Q-R^6]_m\ X^-]$ (3)

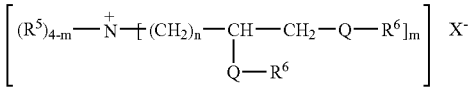

-continued (4)

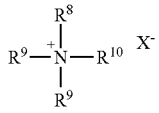

(5) and mixtures thereof;

wherein $R^1$ is $C_{8-16}$ alkyl, each of $R^2$, $R^3$ and $R^4$ is independently selected from the group consisting of $C_{1-4}$ alkyl; $C_{1-4}$ hydroxy alkyl; benzyl; $-(C_2H_4O)_xH$, where x is from about 2 to about 5, and mixtures thereof; wherein Q is a carbonyl unit having the formula:

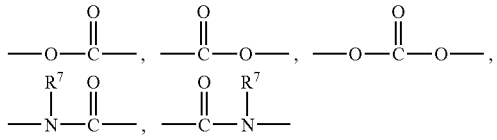

$R^5$ is independently selected from the group consisting of hydrogen, $C_{1-6}$ alkyl, $C_{1-6}$ hydroxyalkyl, and mixtures thereof; each $R^6$ is independently selected from the group consisting of linear or branched $C_{11-22}$ alkyl, linear or branched $C_{11-22}$ alkenyl, and mixtures thereof; $R^7$ is independently selected from the group consisting of hydrogen, $C_{1-4}$ alkyl, $C_{1-4}$ hydroxyalkyl, and mixtures thereof; the index m is from about 1 to about 4; the index n is from about 1 to about 4; wherein $R^8$ is an acyclic aliphatic $C_{8-22}$ hydrocarbon group; $R^9$ is a $C_{1-4}$ saturated alkyl or hydroxyalkyl group, $R^{10}$ is selected from the group consisting of $R^8$ and $R^9$ groups; and mixtures thereof, and wherein X is a compatible anion, selected from the group consisting of halide, methosulfate, acetate, phosphate and mixtures thereof; and (D) a liquid carrier.

24. A structured liquid fabric treatment composition comprising as added components (A) one or more silicone-based cationic fabric care ingredient polymers comprised of alternating units of:

(i) a polysiloxane of the following formula:

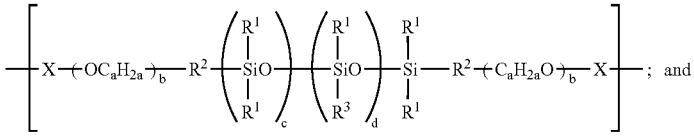

(ii) a divalent organic moiety comprising at least two quaternized nitrogen atoms;

wherein:

$R^1$ is independently selected from the group consisting of $C_{1-22}$ alkyl, $C_{2-22}$ alkenyl, $C_{6-22}$ alkylaryl, aryl, cycloalkyl and mixtures thereof;

$R^2$ is independently selected from the group consisting of divalent organic moieties;

X is independently selected from the group consisting of ring-opened epoxides;

$R^3$ is independently selected from polyether groups having the formula:

$$-M^1(C_aH_{2a}O)_b-M^2$$

wherein $M^1$ is a divalent hydrocarbon residue; $M^2$ is independently selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl, polyalkyleneoxide, (poly)alkoxy alkyl, and mixtures thereof;

a is from about 2 to about 4; b is from 0 to about 100; c is from about 1 to about 1000; and d is from 0 to about 100;

(B) a structuring system comprising a structuring agent, a nonionic emulsifier and an anionic emulsifier, wherein the structuring agent is selected from the group consisting of crystalline, hydroxyl containing stabilizing agents, fatty acids, fatty esters or fatty soap water-insoluble wax-like substances, and mixtures thereof;

(C) one or more cationic scavenging agents for said anionic emulsifier; wherein the cationic scavenging agent comprises a compound selected from the group consisting of:

(1)

$$R^1R^2R^3R^4N^+X^-$$

(2)

$$[(R^5)_{4-m}-\overset{+}{N}-(CH_2)_n-Q-R^6]_m\ X^-]$$

(3)

$$\left[(R^5)_{4-m}-\overset{+}{N}-(CH_2)_n-\underset{\underset{Q-R^6}{|}}{CH}-CH_2-Q-R^6]_m\right]\ X^-$$

-continued (4)

$$R^9-\overset{R^8}{\underset{R^9}{\overset{|}{\underset{|}{\overset{+}{N}}}}}-R^{10}\ X^-$$

(5) and mixtures thereof;

wherein $R^1$ is $C_{8-16}$ alkyl, each of $R^2$, $R^3$ and $R^4$ is independently selected from the group consisting of $C_{1-4}$ alkyl; $C_{1-4}$ hydroxy alkyl; benzyl; $(C_2H_4O)_xH$, where x is from about 2 to about 5, and mixtures thereof; wherein Q is a carbonyl unit having the formula:

$$-O-\overset{O}{\overset{\|}{C}}-,\quad -\overset{O}{\overset{\|}{C}}-O-,\quad -O-\overset{O}{\overset{\|}{C}}-O-,$$

$$-\overset{R^7}{\overset{|}{N}}-\overset{O}{\overset{\|}{C}}-,\quad -\overset{O}{\overset{\|}{C}}-\overset{R^7}{\overset{|}{N}}-$$

$R^5$ is independently selected from the group consisting of hydrogen, $C_{1-6}$ alkyl, $C_{1-6}$ hydroxyalkyl, and mixtures thereof; each $R^6$ is independently selected from the group consisting of linear or branched $C_{11-22}$ alkyl, linear or branched $C_{11-22}$ alkenyl, and mixtures thereof; $R^7$ is independently selected from the group consisting of hydrogen, $C_{1-4}$ alkyl, $C_{1-4}$ hydroxyalkyl, and mixtures thereof; the index m is from about 1 to about 4; the index n is from about 1 to about 4; wherein $R^8$ is an acyclic aliphatic $C_{8-22}$ hydrocarbon group; $R^9$ is a $C_{1-4}$ saturated alkyl or hydroxyalkyl group, $R^{10}$ is selected from the group consisting of $R^8$ and $R^9$ groups; and mixtures thereof, and wherein X is a compatible anion, selected from the group consisting of halide, methosulfate, acetate, phosphate and mixtures thereof; and (D) a liquid carrier.

25. A structured liquid fabric treatment composition comprising as added components (A) one or more silicone-based cationic fabric care ingredient polymers composed of alternating units of:

(i) a polysiloxane of the following formula:

$$\left[-X-(OC_aH_{2a})_b-R^2-\left(\overset{R^1}{\underset{R^1}{\overset{|}{\underset{|}{SiO}}}}\right)_c-\left(\overset{R^1}{\underset{R^3}{\overset{|}{\underset{|}{SiO}}}}\right)_d-\overset{R^1}{\underset{R^1}{\overset{|}{\underset{|}{Si}}}}-R^2-(C_aH_{2a}O)_b-X-\right];\ \text{and}$$

(ii) a cationic divalent organic moiety selected from the group consisting of:

(a)

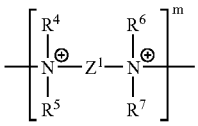

2mA;

(b)

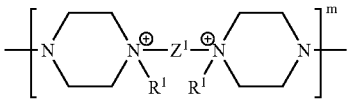

2mA;

(c)

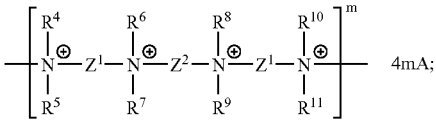

4mA;

(d) a divalent aromatic or aliphatic heterocyclic group, substituted or unsubstituted, containing at least one quaternized nitrogent atom; and (iii) optionally, a polyalkyleneoxide of formula:

$[Y—O—(C_aH_{2a}O)_b—Y]$; and (iv) optionally, a cationic monovalent organic moiety, to be used as an end-group, selected from the group consisting of:

(i)

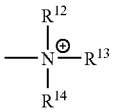

(ii)

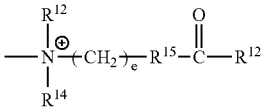

(iii)

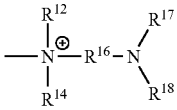

(iv)

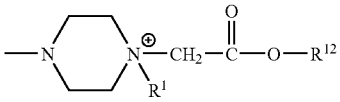

(v) monovalent aromatic or aliphatic heterocycic group, substituted or unsubstituted, containing at least one quaternized nitrogen atom wherein:

$R^4$, $R^5$, $R^6$, $R^7$, $R^8$, $R^9$, $R^{10}$, $R^{11}$ are the same or different, and are selected from the group consisting of $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide; (poly)alkoxy alkyl and mixtures thereof; or in which $R^4$ and $R^6$, or $R^5$ and $R^7$, or $R^8$ and $R^{10}$, or $R^9$ and $R^{11}$ are components of a bridging alkylene group;

$R^{12}$, $R^{13}$, $R^{14}$ are the same or different, and are selected from the group consisting of $C_{1-22}$ alkyl; $C_{2-22}$ alkenyl; $C_{6-22}$ alkylaryl; $C_{1-22}$ hydroxyalkyl; polyalkyleneoxide; (poly)alkoxy alkyl groups and mixtures thereof; and R is —O—or $NR^{19}$;

$R^{16}$ and $M^1$ are the same or different divalent hydrocarbon residues;

$R^{17}$, $R^{18}$, $R^{19}$ are the same or different, and are selected from the group consisting of H, $C_{1-22}$ alkyl, $C_{2-22}$ alkenyl, $C_{6-22}$ alkylaryl, aryl, cycloalkyl, $C_{1-22}$ hydroxyalkyl; polyalkyleneoxide, (poly)alkoxy alkyl, and mixtures thereof; and $Z^1$ and $Z^2$ are the same or different divalent hydrocarbon groups with at least 2 carbon atoms;

Y is a secondary or tertiary amine;

a is from about 2 to about 4; b is from 0 to about 100; c is from about 1 to about 1000; d is from 0 to about 100; e is from about 1 to about 6; m is the number of positive charges associated with the cationic divalent organic moiety, which is greater than or equal to about 2; and A is an anion.

(B) a structuring system comprising a structuring agent, a nonionic emulsifier and an anionic emulsifier, wherein the structuring agent is selected from the group consisting of crystalline, hydroxyl containing stabilizing agents, fatty acids, fatty esters or fatty soap water-insoluble wax-like substances, and mixtures thereof;

(C) one or more cationic scavenging agents for said anionic emulsifier; wherein the cationic scavenging agent comprises a compound selected from the group consisting of:

(1)

$R^1R^2R^3R^4N^+X^-$ (2)

$[(R^5)_{4-m}—\overset{+}{N}—(CH_2)_n—Q—R^6]_m\ X^-]$ (3)

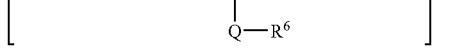

(4)

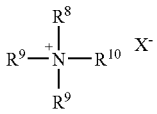

(5) and mixtures thereof;

wherein $R^1$ is $C_{8-16}$ alkyl, each of $R^2$, $R^3$ and $R^4$ is independently selected from the group consisting of $C_{1-4}$ alkyl; $C_{1-4}$ hydroxy alkyl; benzyl; $—(C_2H_4O)_x$ H, where x is from about 2 to about 5, and mixtures thereof; wherein Q is a carbonyl unit having the formula:

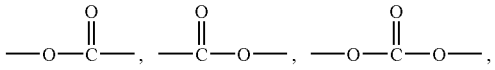

-continued

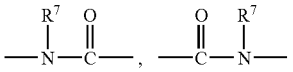

$R^5$ is independently selected from the group consisting of hydrogen, $C_{1-6}$ alkyl, $C_{1-6}$ hydroxyalkyl, and mixtures thereof; each $R^6$ is independently selected from the group consisting of linear or branched $C_{11-22}$ alkyl, linear or branched $C_{11-22}$ alkenyl, and mixtures thereof; $R^7$ is independently selected from the group consisting of hydrogen, $C_{1-4}$ alkyl, $C_{1-4}$ hydroxyalkyl, and mixtures thereof; the index m is from about 1 to about 4; the index n is from about 1 to about 4; wherein $R^8$ is an acyclic aliphatic $C_{8-22}$ hydrocarbon group; $R^9$ is a $C_{1-4}$ saturated alkyl or hydroxyalkyl group, $R^{10}$ is selected from the group consisting of $R^8$ and $R^9$ groups; and mixtures thereof, and wherein X is a compatible anion, selected from the group consisting of halide, methosulfate, acetate, phosphate and mixtures thereof; and (D) a liquid carrier.

26. A structured liquid fabric treatment composition comprising as added components (A) one or more silicone-based cationic fabric care ingredients;

(B) from 0.1% to 20%, by weight of the composition, of a structuring system comprising a structuring agent, a nonionic emulsifier and an anionic emulsifier, wherein the structuring agent is selected from the group consisting of crystalline, hydroxyl containing stabilizing agents, fatty acids, fatty esters or fatty soap water-insoluble wax-like substances, and mixtures thereof and comprises from 0.5% to 10% by weight of the structuring system;

(C) one or more cationic scavenging agents for said anionic emulsifier; wherein the cationic scavenging agent comprises a compound selected from the group consisting of:

(1)

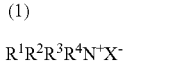

$R^1R^2R^3R^4N^+X^-$ (2)

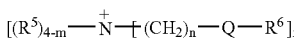

$[(R^5)_{4-m}—\overset{+}{N}—(CH_2)_n—Q—R^6]_m\ X^-]$

-continued (3)

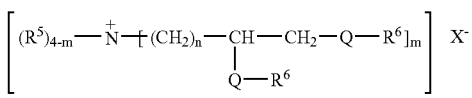

(4)

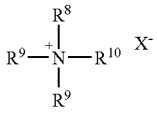

(5) and mixtures thereof;

wherein $R^1$ is $C_{8-16}$ alkyl, each of $R^2$, $R^3$ and $R^4$ is independently selected from the group consisting of $C_{1-4}$ alkyl; $C_{1-4}$ hydroxy alkyl; benzyl; $—(C_2H_4O)_x$ H, where x is from about 2 to about 5, and mixtures thereof; wherein Q is a carbonyl unit having the formula:

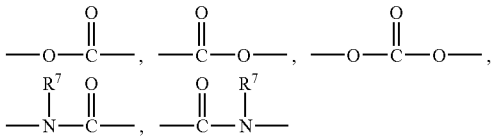

$R^5$ is independently selected from the group consisting of hydrogen, $C_{1-6}$ alkyl, $C_{1-6}$ hydroxyalkyl, and mixtures thereof; each $R^6$ is independently selected from the group consisting of linear or branched $C_{11-22}$ alkyl, linear or branched $C_{11-22}$ alkenyl, and mixtures thereof; $R^7$ is independently selected from the group consisting of hydrogen, $C_{1-4}$ alkyl, $C_{1-4}$ hydroxyalkyl, and mixtures thereof; the index m is from about 1 to about 4; the index n is from about 1 to about 4; wherein $R^8$ is an acyclic aliphatic $C_{8-22}$ hydrocarbon group; $R^9$ is a $C_{1-4}$ saturated alkyl or hydroxyalkyl group, $R^{10}$ is selected from the group consisting of $R^8$ and $R^9$ groups; and mixtures thereof, and wherein X is a compatible anion, selected from the group consisting of halide, methosulfate, acetate, phosphate and mixtures thereof; and (D) a liquid carrier.

* * * * *